US008707535B2

(12) United States Patent
Laible et al.

(10) Patent No.: US 8,707,535 B2
(45) Date of Patent: Apr. 29, 2014

(54) METHOD FOR INSTALLING A BUILT-IN DEVICE ON A UNIT NICHE AND ADJUSTING TOOL

(75) Inventors: Karl-Friedrich Laible, Langenau (DE); Helmut Steichele, Lauingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1540 days.

(21) Appl. No.: 12/085,648

(22) PCT Filed: Oct. 18, 2006

(86) PCT No.: PCT/EP2006/067547

§ 371 (c)(1),
(2), (4) Date: May 27, 2008

(87) PCT Pub. No.: WO2007/062912

PCT Pub. Date: Jun. 7, 2007

(65) Prior Publication Data

US 2009/0282667 A1 Nov. 19, 2009

(30) Foreign Application Priority Data

Nov. 30, 2005 (DE) ..... 10 2005 057 141

(51) Int. Cl.
*B23Q 3/00* (2006.01)

(52) U.S. Cl.
USPC ..... 29/464; 269/329

(58) Field of Classification Search
USPC ..... 29/464, 466, 468, 270, 281.1, 281.4; 33/333, 568, 569, 570; 312/352; 52/126.1, 126.3, 127.7; 269/217, 234, 269/196, 37, 291, 303, 313, 229
See application file for complete search history.

(56) References Cited

U.S. PATENT DOCUMENTS

| | | | | | |
|---|---|---|---|---|---|
| 4,790,507 | A * | 12/1988 | Morrissey | ..... | 248/651 |
| 5,160,126 | A * | 11/1992 | Atkinson | ..... | 269/102 |
| 6,098,265 | A * | 8/2000 | Stojkovic et al. | ..... | 29/464 |
| 6,836,969 | B1 * | 1/2005 | Bates | ..... | 33/42 |
| 7,096,594 | B2 * | 8/2006 | Erickson et al. | ..... | 33/645 |

FOREIGN PATENT DOCUMENTS

| | | |
|---|---|---|
| CH | 464 255 | 10/1968 |
| DE | 1 404 843 | 10/1968 |
| DE | 30 03 953 | 8/1981 |
| DE | 197 26 484 | 12/1998 |
| DE | 198 18 814 | 11/1999 |
| EP | 1 393 652 | 3/2004 |

OTHER PUBLICATIONS

International Search Report PCT/EP2006/067547.

* cited by examiner

*Primary Examiner* — Lee D Wilson
*Assistant Examiner* — Steven A Maynard
(74) *Attorney, Agent, or Firm* — Nixon & Vanderhye P.C.

(57) ABSTRACT

A built-in device, in particular a kitchen device, is provided and includes a front side and a unit wall comprising a unit front surface. Said method consists of the following steps: at least one adjusting device is secured to the built-in device in such a manner that an adjusting edge of the adjusting device protrudes over the front side of the device, the built-in device is inserted into the furniture niche until the adjusting edge is aligned with the front surface of the unit, the built-in device is secured to the unit niche. The invention also relates to an adjusting tool which is adapted, particularly, for carrying out said inventive method.

20 Claims, 5 Drawing Sheets

METHOD FOR INSTALLING A BUILT-IN DEVICE ON A UNIT NICHE AND ADJUSTING TOOL

BACKGROUND OF THE INVENTION

The present invention relates to a method for installing a built-in appliance, in particular a kitchen appliance, in a unit recess of a unit wall and an adjusting tool for installing a built-in appliance, in particular a kitchen appliance, in a unit recess.

When installing built-in appliances in a unit wall, it is important that the built-in appliance is inserted to the correct depth in a unit recess in the unit wall and that the built-in appliance is aligned precisely in the unit recess. If the built-in appliance is not aligned accurately in the unit recess, adjustment of a unit front is difficult or impossible; in particular it is possible for the unit front to collide with the recess.

To avoid such problems, it is known that stops can be provided on the built-in appliance, which come to a stop at the recess front when the built-in appliance has been inserted far enough into the unit recess and is in the correct position in the recess. With different kitchen types and front designs which require the appliance to be positioned at different depths in the unit recess, it is not possible to work with a simple stop. Because there are so many different types of kitchen, front designs and recess shapes, simple stops, which come up against the recess front, cannot be used. For example it is not possible to use the known stop as it is for unit front panels of differing thicknesses.

BRIEF SUMMARY OF THE INVENTION

The object of the present invention is to provide a method for installing a built-in appliance in a unit recess and an adjusting tool, with which it is possible to achieve fast, reliable and precise alignment of the built-in appliance in the unit recess or in relation to a unit wall.

According to the invention this object is achieved by the method for installing a built-in appliance in a unit recess and by the adjusting tool for installing a built-in appliance in a unit recess in a unit wall as specified in the independent claims. Further advantageous embodiments and developments, which can respectively be applied individually or combined with each other appropriately as required, are set out in the respective dependent claims.

The inventive method for installing a built-in appliance, in particular a kitchen appliance, in a unit recess in a unit wall, with the built-in appliance having an appliance front face and the unit wall having a unit front surface, comprises the following method steps:

(S1) securing at least one adjusting tool to the built-in appliance in such a manner that an adjusting edge of the adjusting tool projects over the appliance front face, (S2) inserting the built-in appliance into the unit recess until the adjusting edge is flush with the unit front surface, (S3) securing the built-in appliance in the unit recess.

The kitchen appliance can be a cooker, an oven, a microwave, a dishwasher, a refrigerator, freezer or fridge/freezer, an extractor hood or other appliance. The built-in appliance can be operated electrically or by electric motor. In particular the built-in appliance can be a washing machine or dryer. The built-in appliance can also be embodied as a built-under appliance, in other words an appliance that is free-standing on a base.

With the method the depth position of the built-in appliance in relation to the unit recess is not selected as the reference point but the adjacent unit and/or appliance fronts are selected as a reference. The adjusting edge of the adjusting tool should be flush with these. This allows a pleasing visual effect and collision-free door opening to be achieved.

With the method the adjusting tool is advantageously screwed on the right and left of a door of the built-in appliance. The adjusting tool is advantageously a molded plastic component. The adjusting edge of the adjusting tool represents the thickness of a unit front or in some instances the sum of the thicknesses of the unit front and an adjusting rail. The adjusting rail can be used to secure a unit panel to the built-in appliance and to align it vertically and/or horizontally to the right and left and with regard to angular position. The fitter finds the correct depth position of the built-in appliance by inserting the built-in appliance into the unit recess, until the adjusting edge is aligned with the fronts of the adjacent cupboards. Once the built-in appliance is in the correct position in the unit recess and the built-in appliance has been adjusted to the correct height level, the adjusting tool or tools is/are removed.

The adjusting tool therefore aligns the built-in appliance in relation to the unit front surface of adjacent units. This allows particularly precise adjustment of the built-in appliance in the unit recess.

After step (S3) a panel, advantageously a unit front panel, is secured to the appliance front face or connected to the unit recess. The unit front panel is advantageously secured using an adjusting rail. It is also possible to configure the panel as a double door, with the first door being connected to the built-in appliance and the second door being connected to the unit recess.

In one particularly advantageous embodiment of the invention the adjusting edge projects over the front face of the appliance by a length corresponding to the thickness of the panel or the sum of the thicknesses of the panel and adjusting rail. This ensures that a panel front surface lies flush with the unit front surface, so that the unit wall has a uniform appearance.

At least three, in particular at least four, adjusting tools are advantageously secured to the built-in appliance. The use of two adjusting tools on the left and right sides of the built-in appliance is advantageous, in order to adjust the horizontal angular position of the built-in appliance in the unit recess precisely. The use of at least three adjusting tools is advantageous, in order to be able to adjust the angular position of the built-in appliance in the vertical plane precisely as well as the angular position in the horizontal plane. Using four adjusting tools, with two adjusting tools respectively being provided on one side respectively, i.e. a first adjusting tool bottom left, a second adjusting tool top left, a third adjusting tool bottom right and a fourth adjusting tool top right, it is possible to adjust the built-in appliance particularly precisely in the unit recess.

The adjusting tools are distributed in particular over the periphery of the appliance front face, with regular distribution over the periphery being particularly preferred.

In one specific embodiment, after step (S3), in particular before a further panel is fitted on the appliance front face of the built-in appliance, the adjusting tool or adjusting tools is/are removed from the built-in appliance.

The inventive adjusting tool for installing a built-in appliance, in particular a kitchen appliance, in a unit recess for implementing the inventive method has an adjusting edge, a contact surface, which rests on an appliance front face of the built-in appliance, and a securing element for securing the adjusting tool to the built-in appliance. The adjusting tool allows precise alignment of the built-in appliance in the unit recess, in such a manner that a pleasing visual appearance and collision-free door opening are achieved more easily.

The adjusting tool is made in particular of plastic and can be produced by injection molding. The adjusting tool can be intended for a single use.

The adjusting edge is advantageously height-adjustable. The adjusting tool with a height-adjustable edge can be used for unit front panels of differing thicknesses. This makes the adjusting tool particularly versatile.

The adjusting edge projects in particular in a range between 10 mm and 50 mm, in particular between 15 mm and 25 mm, over the contact surface or appliance front face. In one particularly advantageous embodiment of the invention the adjusting tool has a support foot to protect a door provided on the built-in appliance during transportation. The support foot extends in particular to a front face, in particular a front mounting, of the built-in appliance and is supported there likewise. The support foot allows the door to be fixed during transportation of the built-in appliance, thereby preventing for example deformation of a seal on the door during transportation and avoiding damage to the door or a seal attached to the door.

In one specific embodiment of the invention the adjusting tool has an installation marking. The fitter uses the installation marking to determine directly where the adjusting edge is located, how the adjusting tool should be aligned on the built-in appliance and how far the built-in appliance has to be inserted into the unit recess.

The adjusting tool can advantageously be screwed, hooked or clipped to the built-in appliance by means of the securing element.

A number of adjusting edges and/or a number of adjusting markings are advantageously provided on the adjusting tool for panels of differing thicknesses. An adjusting tool can thus also be used for unit front panels of differing thicknesses and/or recesses of differing shapes. The adjusting marking is then used correspondingly like the adjusting edge as the criterion for aligning the built-in appliance in the unit recess.

BRIEF DESCRIPTION OF THE DRAWINGS

Further advantageous details and specific embodiments are described in more detail with reference to the drawing below, which is not intended to restrict the invention but simply to illustrate it by way of an example. In the schematic drawing

DETAILED DESCRIPTION OF THE PRESENT INVENTION

Figure 1:
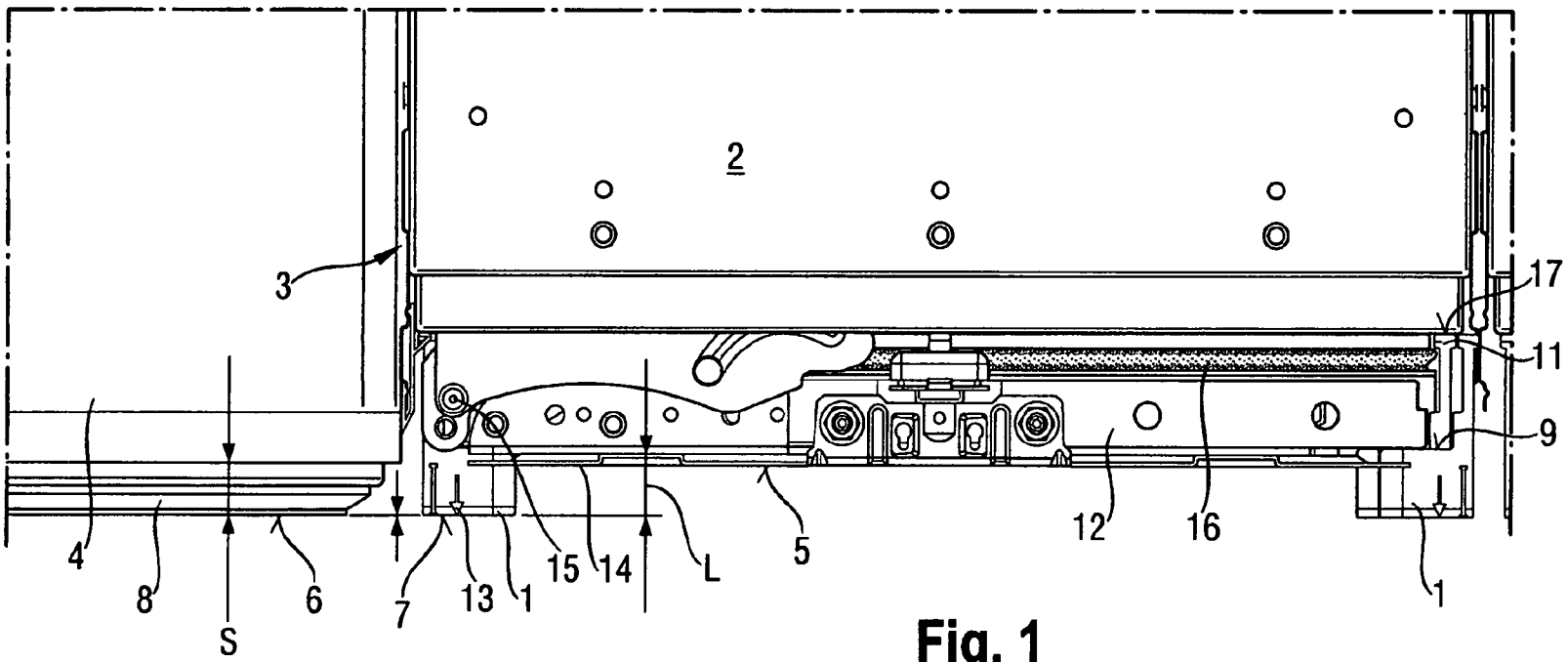
FIG. 1 shows a horizontal section through a unit wall at the level of an upper edge of a built-in appliance viewed from above.
Figure 2:
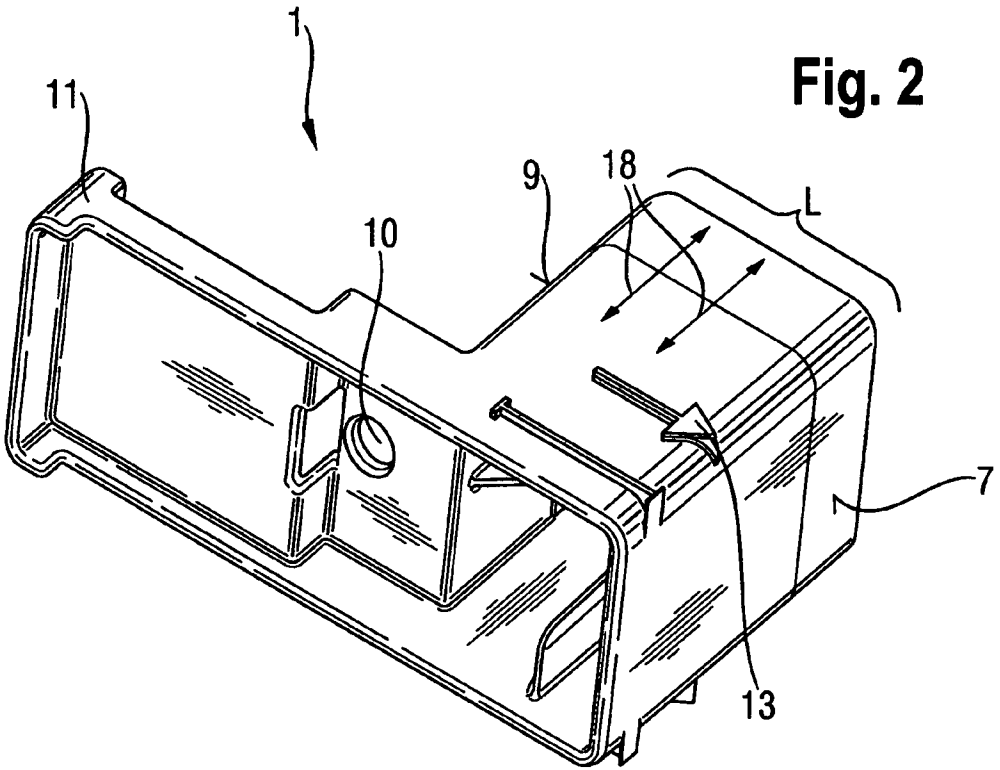
FIG. 2 shows an inventive adjusting tool.

FIG. 1 shows a top view of a built-in appliance 2 in a unit recess 3 of a unit wall 4, with an inventive adjusting tool 1 secured on the left and right of the built-in appliance 2. The adjusting tool 1 has an adjusting edge 7 indicated by an installation marking 13. When the built-in appliance 2 is being installed in the unit recess 3, the adjusting edge 7 is made flush with a unit front surface 6 of the unit wall 4. The adjusting edge 7 projects over a length L over an appliance front face 5 of the built-in appliance 2, corresponding to a thickness S of a panel 8 for the built-in appliance 2. The panel 8 is secured to the built-in appliance 2 with the aid of an adjusting rail 14. The adjusting rail 14 serves to align the panel 8, which is provided as the unit front panel, horizontally and/or vertically in relation to the unit wall 4. The adjusting tool 1 is screwed to the built-in appliance 2. A contact surface 9 of the adjusting tool 1 rests on the built-in appliance 2. The contact surface 9 can in particular rest on the appliance front face 5. The adjusting tool 1 can be used to adjust the built-in appliance 2 precisely in the unit recess 3 in respect of a depth position in the unit recess 3. The built-in appliance 2 has a door 12, which is connected by a hinge 15 to the built-in appliance 2. The adjusting tool 1 also serves to protect a door seal 16 of the door 12 during transportation of the built-in appliance 2. For this purpose the adjusting tool 1 has a support foot 11, which is supported on a front face, in particular a front mounting 17, of the built-in appliance 2, thereby preventing the door seal 16 being squeezed out of shape during transportation. The adjusting tool 1 is advantageously secured to the built-in appliance 2 in the factory. The built-in appliance 2 can also be provided in the form of a built-under appliance.

Figure 4:
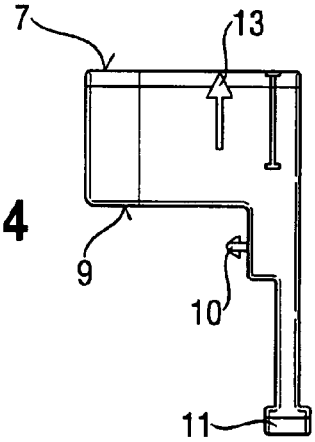
FIGS. 4-7 show different perspective views of the inventive built-in appliance in FIG. 2.
Figure 5:
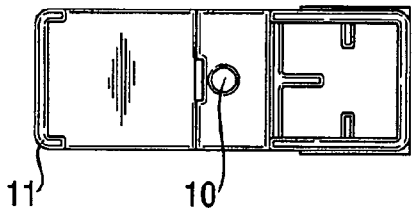
Figure 6:
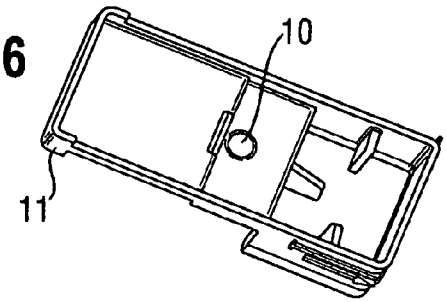
Figure 7:
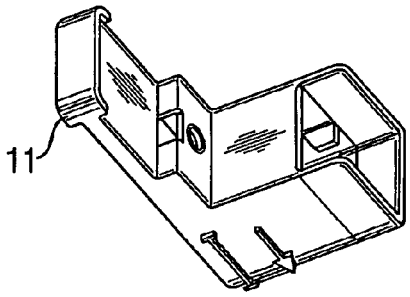

FIGS. 2, 4-7 show different perspective views of the inventive adjusting tool with the contact surface 9, which comes to rest on the built-in appliance 2, in particular on its appliance front face 5, the adjusting edge 7, which is made flush with the unit front surface 6, a securing element 10, with which the adjusting tool 1 can be screwed to the built-in appliance 2, in particular to its door 12, and the support foot 11, which serves as protection during transportation and prevents the door 12 striking the front mounting 17 of the built-in appliance 2 in an uncontrolled manner as well as excessive squeezing of a door seal 16 of the built-in appliance 2. The adjusting edge 7 projects by length L over the appliance front face 5, in such a manner that subsequent securing of a panel 8 to the appliance front face 5 of the built-in appliance 2 causes the front face of said panel 8 to be flush with the unit front surface 6 of adjacent units. The securing element 10 can be formed by an opening to hold a screw or, as shown in FIG. 4, by a clip. A number of adjusting markings 18 are provided on the adjusting tool 1 for panels 8 of differing thicknesses, with a first adjusting marking 18 being used for a unit front panel with a thickness of 15 mm, a second adjusting marking 18 being used for a unit front panel with a thickness of 19 mm and the adjusting edge 7 being used for a unit front panel with a thickness of 25 mm. This gives the adjusting tool 1 a high level of versatility for different kitchen types.

Figure 3:
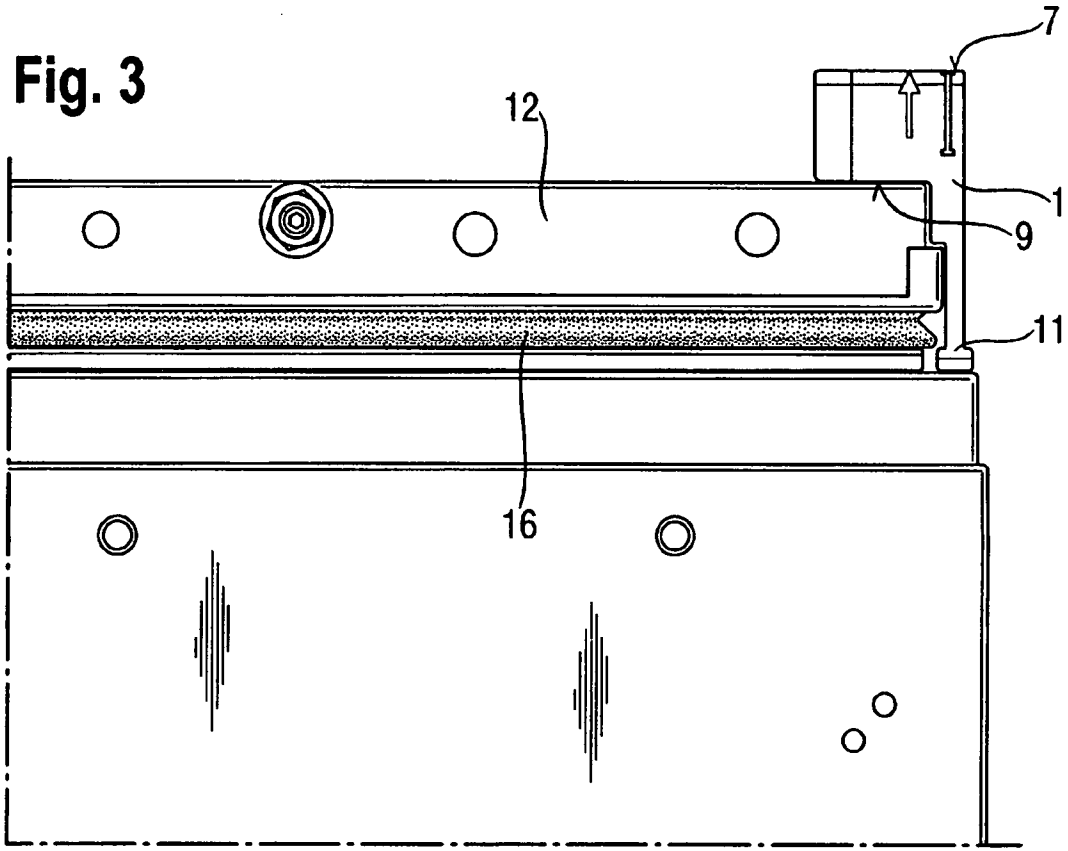
FIG. 3 shows the adjusting tool in FIG. 2 on a built-in appliance.

FIG. 3 shows a section according to FIG. 1 with the inventive adjusting tool 1 on the door 12 of the built-in appliance 2.

Figure 8:
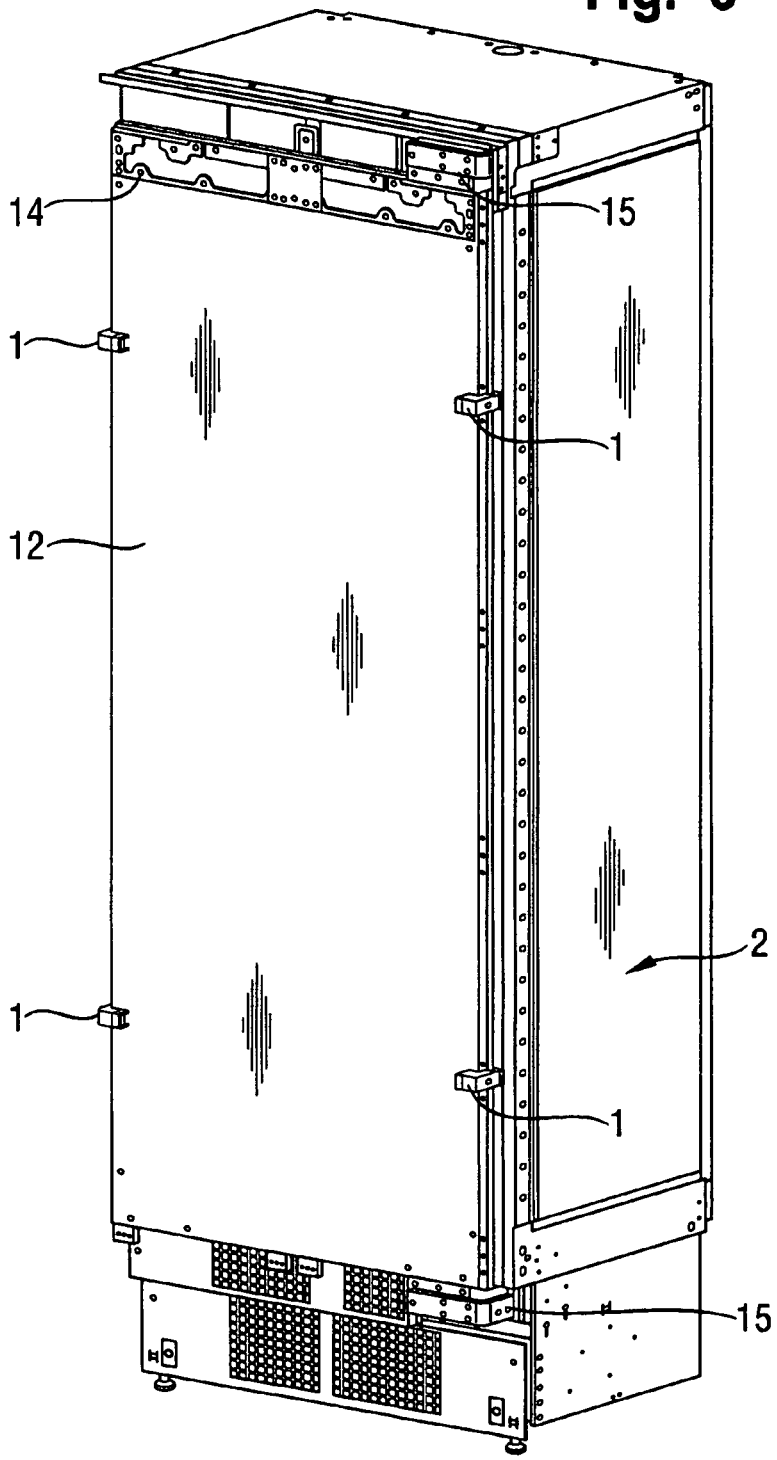
FIG. 8 shows a built-in appliance for installation in a unit recess.

FIG. 8 shows a built-in appliance 2 for installation in a unit recess, on which four inventive adjusting tools, namely a first adjusting tool 1 bottom left, a second adjusting tool top left, a third adjusting tool bottom right and a fourth adjusting tool top right, are distributed in a regular manner over the periphery of the appliance front face. The built-in appliance has a door 12, which is connected by hinges 15 to the built-in appliance 2.

The invention relates to a method for installing a built-in appliance 2, in particular a kitchen appliance, in a unit recess 3 in a unit wall 4, with the built-in appliance 2 having an appliance front face 5 and the unit wall 4 having a unit front surface 6, and comprises the following method steps: (S1) securing at least one adjusting tool 1 to the built-in appliance 2 in such a manner that an adjusting edge 7 of the adjusting tool 1 projects over the appliance front face 5, (S2) inserting the built-in appliance 2 into the unit recess 3 until the adjusting edge 7 is flush with the unit front surface 6, (S3) securing the built-in appliance 2 in the unit recess 3; as well as an adjusting tool 1 suitable and in particular intended for implementing the inventive method. With the inventive method and with the aid of the inventive adjusting tool 1 it is possible to align the built-in appliance 2 in the unit recess 3 easily, reliably, quickly and precisely.

LIST OF REFERENCE CHARACTERS

1 Adjusting tool
2 Built-in appliance
3 Unit recess
4 Unit wall
5 Appliance front face
6 Unit front surface
7 Adjusting edge
8 Panel
9 Contact surface
10 Securing element
11 Support foot
12 Door
13 Installation marking
14 Adjusting rail
15 Hinge
16 Door seal
17 Front mounting
18 Adjusting markings
L Length
S Thickness

The invention claimed is:

1. A kitchen appliance adjusting tool configured to align a kitchen appliance within a unit recess, the kitchen appliance adjusting tool comprising:

an adjusting edge;

a contact surface opposing the adjusting edge and adapted to rest on a front face of the kitchen appliance when the tool is secured to the kitchen appliance; and a securing element configured to secure the tool to a side face of the kitchen appliance so that the adjusting edge or a predetermined marked point between the adjusting edge and the contact surface is aligned flush with a front edge of the unit recess when the kitchen appliance is correctly located within the recess.

2. The tool as claimed in claim 1, wherein the adjusting edge is height-adjustable.

3. The tool as claimed in claim 1, wherein the adjusting edge projects in a range between 10 mm and 50 mm over the contact surface.

4. The tool as claimed in claim 1, wherein the adjusting edge projects in a range between 15 mm and 25 mm over the contact surface.

5. The tool as claimed in claim 1 further comprising a support foot structured to protect a door seal on the kitchen appliance during transportation.

6. The tool as claimed in claim 1 further including an installation marking.

7. The tool as claimed in claim 1, wherein the tool is plastic.

8. The tool as claimed in claim 1, wherein the securing element comprises at least one of a screw, a hook and a clip.

9. The tool as claimed in claim 1, wherein the tool comprises a plurality of adjusting edges with each adjusting edge projecting over the contact surface by a unique distance, and wherein the different distances correspond to different unit recess shapes and/or different panels configured to enclose the unit recess, each of the different panels having a unique panel thickness.

10. The tool as claimed in claim 1, wherein the tool comprises at least one adjusting marking between the adjusting edge and the contact surface, wherein the adjusting edge and each of the at least one adjusting marking correspond to different unit recess shapes and/or different panels configured to enclose the unit recess, each of the different panels having a unique panel thickness.

11. The tool as claimed in claim 1 further comprising a support foot extending from the contact surface in a direction opposite the adjusting edge, wherein the securing element is located on the support foot.

12. The tool as claimed in claim 11, wherein the securing element is configured to engage a side surface of a kitchen appliance door and a free end of the support foot is configured to engage a forward facing surface of the kitchen appliance when the tool is secured to the kitchen appliance.

13. The tool as claimed in claim 12, wherein the support foot is configured to prevent the kitchen appliance door from moving toward the forward facing surface of the kitchen appliance when the tool is secured to the kitchen appliance.

14. The tool as claimed in claim 1, wherein the tool is configured to be removably secured to the kitchen appliance.

15. A kitchen appliance alignment system configured to align a kitchen appliance within a unit recess, the kitchen appliance alignment system comprising:

a kitchen appliance;

a unit with a recess configured to receive the kitchen appliance; and a plurality of alignment tools as claimed in claim 1, wherein the tools are secured at different locations around a periphery of the front face of the kitchen appliance, and the plurality of alignment tools are configured to align the front face of the kitchen appliance with a front face of the unit.

16. A kitchen appliance alignment system according to claim 15, wherein the kitchen appliance is a built-in kitchen appliance.

17. A kitchen appliance alignment tool according to claim 5, wherein the support foot is located at an end of an arm extending from the contact surface.

18. A kitchen appliance alignment tool according to claim 17, wherein the arm is contoured to conform to a shape of a door of the kitchen appliance.

19. A kitchen appliance alignment tool according to claim 17, wherein the arm comprises a recess configured to receive a door of the kitchen appliance.

20. A kitchen appliance alignment tool according to claim 17, wherein the arm has a stepped structure.

* * * * *

UNITED STATES PATENT AND TRADEMARK OFFICE

CERTIFICATE OF CORRECTION

PATENT NO. : 8,707,535 B2
APPLICATION NO. : 12/085648
DATED : April 29, 2014
INVENTOR(S) : Laible et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1707 days.

Signed and Sealed this
Twenty-ninth Day of September, 2015

Michelle K. Lee

Michelle K. Lee
*Director of the United States Patent and Trademark Office*